US011133588B1

(12) United States Patent
Matos et al.

(10) Patent No.: US 11,133,588 B1
(45) Date of Patent: Sep. 28, 2021

(54) PHASE CHANGE MATERIAL BASED RECONFIGURABLE INTELLIGENT REFLECTIVE SURFACES

(71) Applicants: Randy Matos, Miami, FL (US); Nezih Pala, Miami, FL (US)

(72) Inventors: Randy Matos, Miami, FL (US); Nezih Pala, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/194,924

(22) Filed: Mar. 8, 2021

(51) Int. Cl.
*H01Q 3/46* (2006.01)
*H01Q 15/14* (2006.01)
*H01Q 3/34* (2006.01)

(52) U.S. Cl.
CPC ..... *H01Q 3/46* (2013.01); *H01Q 3/34* (2013.01); *H01Q 15/148* (2013.01)

(58) Field of Classification Search
CPC ..... H01Q 3/46; H01Q 3/34; H01Q 3/247; H01Q 15/148; H01Q 15/0066; H01Q 9/0442; H01Q 1/48
See application file for complete search history.

(56) References Cited

U.S. PATENT DOCUMENTS 9,923,267 B1 * 3/2018 Pala ..... H01Q 9/065
2015/0295309 A1 * 10/2015 Manry, Jr. ..... H01Q 3/247 342/374
2016/0013549 A1 * 1/2016 Schaffner ..... H01Q 1/06 343/724
2018/0122910 A1 * 5/2018 Eom ..... H01L 29/24

OTHER PUBLICATIONS

Gerislioglu et al., VO2-Based Reconfigurable Antenna Platform with Addressable Microheater Matrix, Advanced Electronic Materials, 2017, 3, 1700170.
Huitema et al., Highly Integrated VO2-based Antenna for Frequency Tunability at Millimeter-Wave Frequencies, 2016 International Workshop on Antenna Technology (iWAT), Feb. 29-Mar. 2, 2016.
Di Renzo et al., Smart radio environments empowered by reconfigurable AI meta-surfaces: An idea whose time has come. EURASIP Journal on Wireless Communications and Networking 2019, No. 1 (2019): 1-20.
Subrt et al., Controlling Propagation Environments Using Intelligent Walls, 6th European Conference on Antennas and Propagation (EUCAP), Prague, 2012.

(Continued)

*Primary Examiner* — Awat M Salih
(74) *Attorney, Agent, or Firm* — Saliwanchik, Lloyd & Eisenschenk

(57) ABSTRACT

Ultra-reconfigurable reflectarrays using vanadium dioxide ($VO_2$) are provided, as well as methods of fabricating and using the same. The ultra-reconfigurable reflectarrays operate based on the unique phase-change properties of $VO_2$, by including a heating element configured to heat desired areas of a $VO_2$ layer/reflector, such that the $VO_2$ reflector/layer can be reconfigured to have a desired pattern heated (and therefore changed to a conducting state) at a given time, with a good spatial resolution of the desired pattern.

20 Claims, 13 Drawing Sheets

(56) References Cited

OTHER PUBLICATIONS

Subrt et al., Intelligent walls as autonomous parts of smart indoor environments, IET Commun. 6(8), 1004-1010 (2012).
Tan et al., Increasing Indoor Spectrum Sharing Capacity using Smart Reflect-Array, IEEE ICC 2016—Wireless Communications Symposium, 2016.
Tan et al., Enabling Indoor Mobile Millimeter-wave Networks Based on Smart Reflect-arrays, IEEE INFOCOM 2018—IEEE Conference on computer Communications, 2018.
Liaskos et al., Using Any Surface to Realize a New Paradigm for Wireless Communications, Commun. ACM 61(11), 30-33 (2018).
Huang et al., Introduction to Reflectarray Antenna, Chapter 1, Hoboken, NJ, USA: Wiley, 2007, ISBN: 978 1 118 84676 6.
Huang et al., Practical Design Approach, Chapter 4, Hoboken, NJ, USA: Wiley, 2007, ISBN: 978 1 118 84676 6.
Huang et al., Broadband Techniques, Chapter 5, Hoboken, NJ, USA: Wiley, 2007, ISBN: 978 1 118 84676 6.
Nayeri et al., Introduction to Reflectarray Antennas, Chapter 1, John Wiley & Sons Ltd., 2018.
Nayeri et al., Analysis and Design of Reflectarray Elements, Chapter 2, John Wiley & Sons Ltd., 2018.
Nayeri et al., Bandwidth of Reflectarray Antennas, Chapter 5, John Wiley & Sons Ltd., 2018.
Nayeri et al., Multi-Beam and Shaped-Beam Reflectarray Antennas, Chapter 9, John Wiley & Sons Ltd., 2018.
Nayeri et al., Beam-scanning Reflectarray Antennas, Chapter 10, John Wiley & Sons Ltd., 2018, a total of 121 pages [Part 1—Page Count 1-60].
Nayeri et al., Beam-scanning Reflectarray Antennas, Chapter 10, John Wiley & Sons Ltd., 2018, a total of 121 pages [Part 2—Page Count 61-121].
Nayeri et al., Reflectarray Engineering and Emerging Applications, Chapter 11, John Wiley & Sons Ltd., 2018.
N.F. Mott, Transition-metal compounds, Chapter 5, 1st ed. London: Taylor and Francis, 1990.

* cited by examiner

PHASE CHANGE MATERIAL BASED RECONFIGURABLE INTELLIGENT REFLECTIVE SURFACES

GOVERNMENT SUPPORT

This invention was made with government support under W911NF-12-2-0023 awarded by Army Research Laboratory (ARL) Multiscale Multidisciplinary Modeling of Electronic Materials Collaborative Research Alliance. The government has certain rights in the invention.

BACKGROUND

Looking to the future of wireless communications, two major issues inhibit wireless network operators from realizing an intelligent, sensing, and computing platform, and those are: 1) a lack of configurable radio environments, which reduces control over the radio waves; and 2) the fact that data transmission requires new signals to be created, which consumes a large amount of power. In order to attempt to create smart radio environments, various forms of reconfigurable intelligent surfaces (RISs) have been proposed, including: programmable, frequency-selective surfaces; smart reflectarrays or mirrors; embedding arrays of low-cost antennas; and coating surfaces with reconfigurable meta-surfaces.

Despite advances in reflectarrays, highly reconfigurable reflectarrays that rely on electronic beam steering are still in their infancy. Mechanical beam steering has its uses but suffers from the arrays being designed for a specific polarization. Also, the materials tend to be unsuitable for moving, as the whole structure needs to be rotated or displaced in some manner. Highly reconfigurable reflectarray antennas require electronic beam steering, as the patch elements can be tuned and modified for real time beam steering. Tunable materials and lumped components are the most widely used techniques for emerging reconfigurable reflectarrays. Devices using tunable materials such as liquid crystals, ferroelectrics, and graphene have been proposed, but major hurdles exist. These hurdles in developing highly reconfigurable reflectarray antennas using tunable materials include keeping reflection losses as low as possible, keeping reflection phase range as wide as possible, and being able to achieve wide beam widths such that all the patch elements can receive the incident signals from distant feeds.

BRIEF SUMMARY

In order to address the challenges that exist with respect to highly reconfigurable reflectarrays, embodiments of the subject invention provide novel and advantageous ultra-reconfigurable reconfigurable intelligent surfaces (RISs) (e.g., reflectarrays) using phase change materials (e.g., vanadium dioxide ($VO_2$)), and methods of fabricating and using the same. $VO_2$ is discussed extensively herein as an example, but embodiments are not limited thereto; the devices and methods of embodiments of the subject invention can be realized using any phase change material with suitable characteristics. The ultra-reconfigurable reflectarrays operate based on the unique phase-change properties of phase change materials (e.g., $VO_2$), by including a heating element configured to heat desired areas of a phase change material layer/reflector (e.g., a $VO_2$ layer/reflector), such that the phase change material layer/reflector (e.g., $VO_2$ layer/reflector) can be reconfigured to have a desired pattern heated (and therefore activated) at a given time, with a good spatial resolution of the desired pattern. Reflectarrays using $VO_2$ as the main reflector do not exist in the art, and an ultra-reconfigurable metasurface reflectarray antenna utilizing $VO_2$ can mitigate the limitations that currently exist with respect to highly reconfigurable reflectarrays.

In an embodiment, a reflectarray comprises: a substrate; a micro-heater matrix disposed on the substrate and comprising a micro-heater layer and a plurality of micro-heaters, the plurality of micro-heaters being configured to be controlled to turn on or off individually; and a $VO_2$ layer disposed on the micro-heater matrix. The $VO_2$ layer can be configured such that specific areas of the $VO_2$ layer, corresponding to micro-heaters of the plurality of micro-heaters that are turned on and heated to a predetermined temperature, heat up and cause the specific areas of the $VO_2$ layer to change from insulating to conducting. The reflectarray can further comprise an intermediate layer (e.g., a silicon carbide (SiC) layer, such as a hexagonal SiC (6H—SiC) layer) disposed between the $VO_2$ layer and the micro-heater matrix. A dielectric constant of the intermediate layer can be higher (or can alternatively be lower) than that of the substrate. The micro-heater layer can be, for example, an insulating layer. The plurality of micro-heaters can be configured to be controlled to turn on or off individually via electronic control. The reflectarray can further comprise a ground plane disposed below the substrate; and/or a plurality of conductive lines disposed on the substrate, the plurality of conductive lines comprising a ground line and a plurality of voltage lines. The plurality of micro-heaters can be contained within a patch area on the micro-heater layer, and the patch area can have a width of, for example, no more than 100 μm and a length of, for example, no more than 100 μm. The predetermined temperature can be, for example, at least 343 Kelvin (K) (e.g., at least 350 K, 360 K, 370 K, 380 K, 390 K, 400 K, 410 K, 420 K, 430 K, 440 K, 450 K, 460 K, 470 K, 480 K, 490 K, or 500 K).

In another embodiment, a method of steering a beam using a reflectarray can comprise: providing the reflectarray, the reflectarray comprising a substrate, a micro-heater matrix disposed on the substrate and comprising a micro-heater layer and a plurality of micro-heaters, the plurality of micro-heaters being configured to be controlled to turn on or off individually, and a $VO_2$ layer disposed on the micro-heater matrix, the $VO_2$ layer configured such that specific areas of the $VO_2$ layer, corresponding to micro-heaters of the plurality of micro-heaters that are turned on and heated to a predetermined temperature, heat up and cause the specific areas of the $VO_2$ layer to change from insulating to conducting; controlling the plurality of micro-heaters to turn on a subset of micro-heaters of the plurality of micro-heaters and allow the subset of micro-heaters to heat to the predetermined temperature, such that the specific areas of the $VO_2$ layer change from insulating to conducting in a desired pattern for steering the beam; and providing the beam from a feed antenna towards the reflectarray such that the $VO_2$ layer with the specific areas forming the desired pattern reflects and steers the beam. The reflectarray can further comprise an intermediate layer (e.g., an SiC layer, such as a 6H—SiC layer) disposed between the $VO_2$ layer and the micro-heater matrix. A dielectric constant of the intermediate layer can be higher (or can alternatively be lower) than that of the substrate. The micro-heater layer can be, for example, an insulating layer. The plurality of micro-heaters can be configured to be controlled to turn on or off individually via electronic control. The reflectarray can further comprise a ground plane disposed below the substrate; and/or a plurality of conductive lines disposed on the substrate, the plurality of conductive lines comprising a ground line and a plurality of voltage lines. The plurality of micro-heaters can be contained within a patch area on the micro-heater layer, and the patch area can have a width of, for example, no more than 100 μm and a length of, for example, no more than 100 μm. The predetermined temperature can be, for example, at least 343 Kelvin (K) (e.g., at least 350 K, 360 K, 370 K, 380 K, 390 K, 400 K, 410 K, 420 K, 430 K, 440 K, 450 K, 460 K, 470 K, 480 K, 490 K, or 500 K).

BRIEF DESCRIPTION OF DRAWINGS

FIG. 3(*b*) shows a cross-sectional view of a reflectarray, according to an embodiment of the subject invention, with a gap representing air and bonding laminate. The scale bar is 0.25 mm at the halfway point and 0.5 mm at the end of the black section.

FIG. 9(*b*) shows a plot of temperature (in K) versus time (in s), illustrating high resolution time-dependent analysis, for an on-off-on cycle, at the center of the patch, the edge of the patch, and at the midpoint between patch edges. The (black) line with the square data points is for the center; the (red) line with the circular data points is for the edge; and the (blue) line with the triangular data points is for the midpoint.

FIG. 11(*b*) shows a cross-sectional view of a reflectarray according to an embodiment of the subject invention. Although FIG. 11(*b*) lists certain materials and thicknesses, these are for exemplary purposes only, and embodiments of the subject invention are not limited thereto.

FIG. 12(*b*) shows a plot of losses (in dB) versus square patch size (in mm) illustrating reflection loss curves of three different simulated hybrid structures at a frequency of 32 GHz. The (black) line with the square data points is for a non-hybrid; the (red) line with the circular data points is for the ideal case; the (blue) line with the right-side-up triangular data points is for an air gap; the (pink) line with the upside-down triangular data points is for bond-SiC; the (green) line with the diamond data points is for bond-BeO; and the (dark blue) line with the left-pointing triangular data points is for bond-AlN.

FIG. 12(*c*) shows a plot of reflection phase (in degrees) versus square patch size (in mm) illustrating reflection phase curves of a simulated standard structure and hybrid structure (see FIG. 11(*b*)) at a frequency of 5 GHz. The (black) line with the square data points is for the non-hybrid; and the (red) line with the circular data points is for the hybrid.

FIG. 12(*d*) shows a plot of losses (in dB) versus square patch size (in mm) illustrating reflection loss curves of a simulated standard structure and hybrid structure (see FIG. 11(*b*)) at a frequency of 5 GHz. The (black) line with the square data points is for the non-hybrid; and the (red) line with the circular data points is for the hybrid.

DETAILED DESCRIPTION

Embodiments of the subject invention provide novel and advantageous ultra-reconfigurable reconfigurable intelligent surfaces (RISs) (e.g., reflectarrays) and metasurfaces using phase change materials (e.g., vanadium dioxide ($VO_2$)), and methods of fabricating and using the same. $VO_2$ is discussed extensively herein as an example, but embodiments are not limited thereto; the devices and methods of embodiments of the subject invention can be realized using any phase change material with suitable characteristics. The ultra-reconfigurable RISs (e.g., reflectarrays) and metasurfaces operate based on the unique phase-change properties of the phase change material (e.g., $VO_2$), by including a heating element configured to heat desired areas of a phase change material layer/reflector (e.g., a $VO_2$ layer/reflector), such that the phase change material layer/reflector (e.g., $VO_2$ layer/reflector) can be reconfigured to have a desired pattern heated (and therefore activated) at a given time, with a good spatial resolution of the desired pattern. Reflectarrays using $VO_2$ as the main reflector do not exist in the art, and an ultra-reconfigurable metasurface reflectarray antenna utilizing $VO_2$ can mitigate the limitations that currently exist with respect to highly reconfigurable reflectarrays.

As a metal-to-insulator transition (MIT) material, $VO_2$ transitions to a metallic state when it is heated above a critical temperature of about 69° C. (343 K). This transition occurs due to a change in its crystal structure, which changes from monoclinic to a tetragonal structure. In order to achieve this transition, various methods can be used such as conductive heating, photo-thermal heating, Joule heating, and optical stimuli. This transition has also been attained using static electric fields. Due to the changes in resistivity and permittivity brought about by the transition, $VO_2$ is an attractive material for applications in switching, optics, thermal diodes, antennas, waveguides, and resonators.

Figure 1:
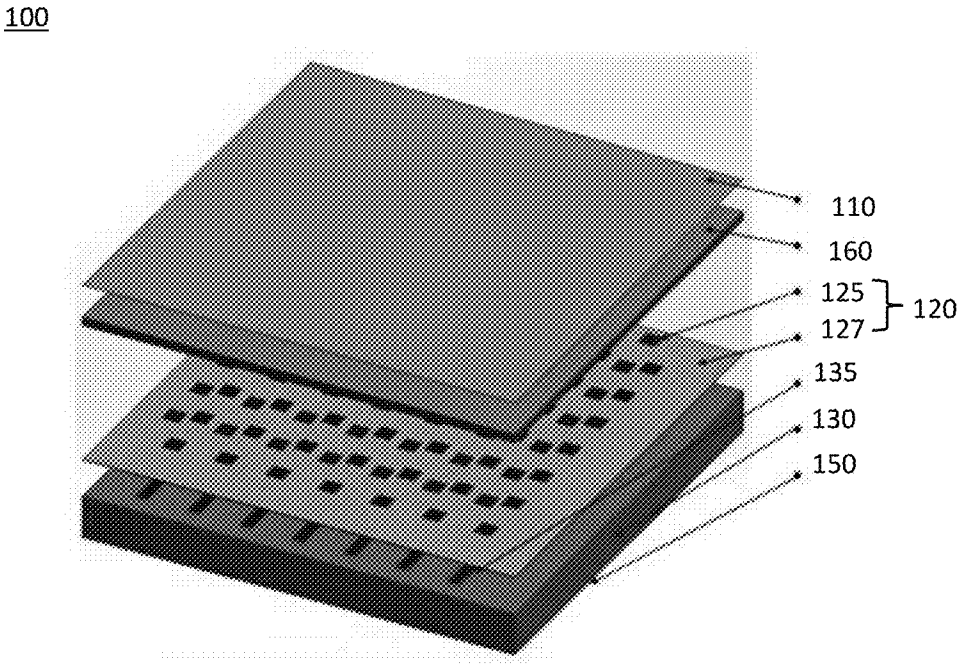
FIG. 1 shows an exploded schematic view of a reflectarray, according to an embodiment of the subject invention.
Figure 2:
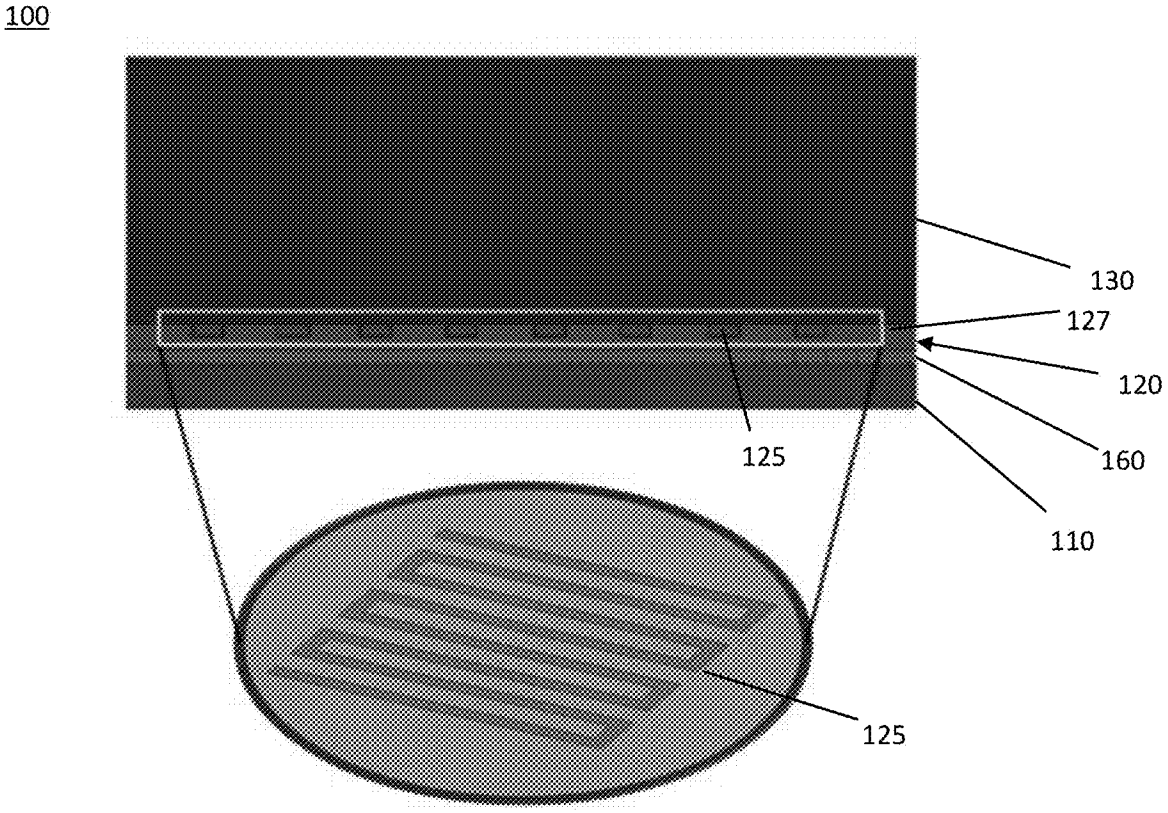
FIG. 2 shows a cross-sectional view of a reflectarray, according to an embodiment of the subject invention. The enlarged portion shows a close-up of a heating element.
Figure 11A:
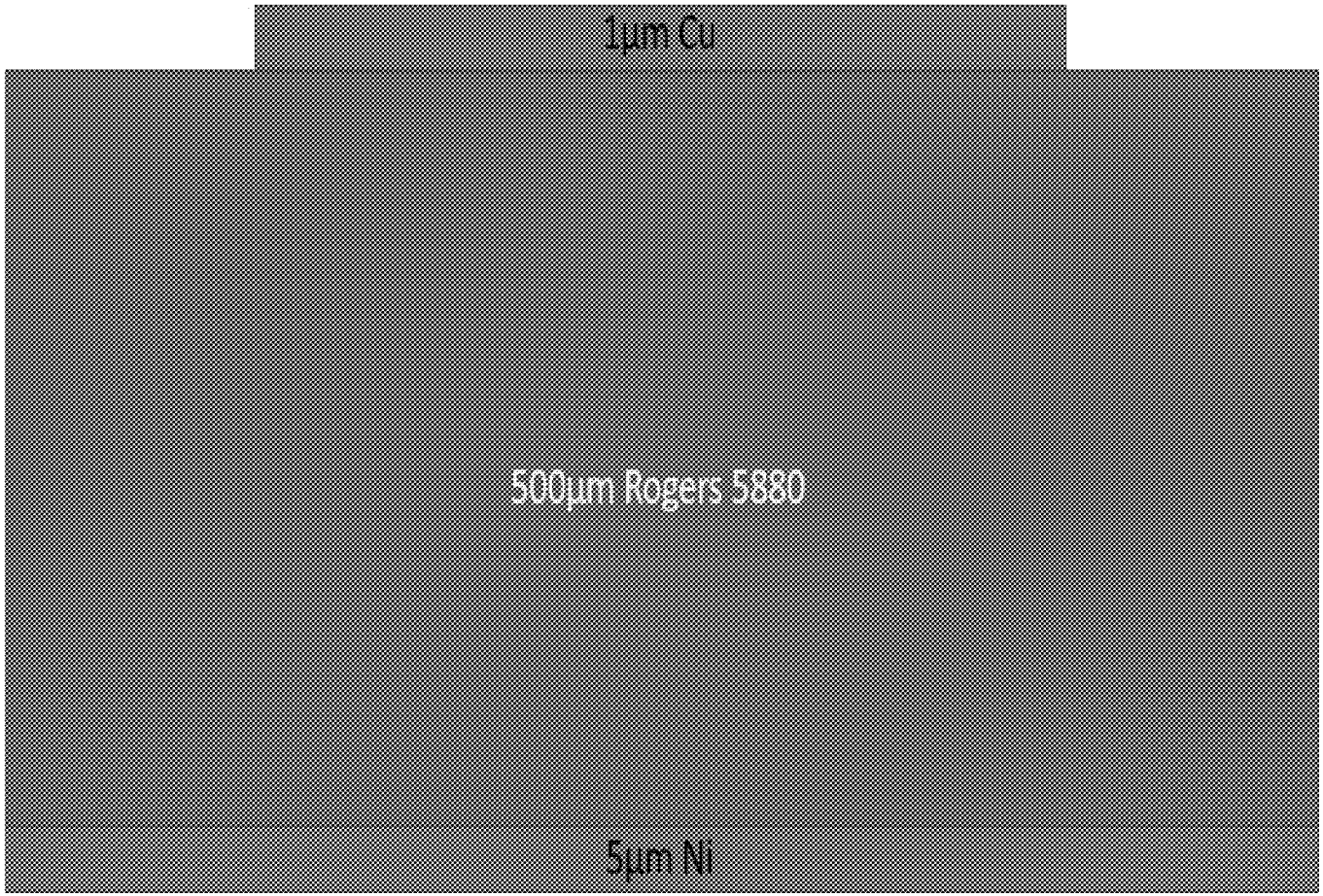
FIG. 11(*a*) shows a cross-sectional view of a conventional reflectarray with only metal and Rogers 5880®.
Figure 11B:
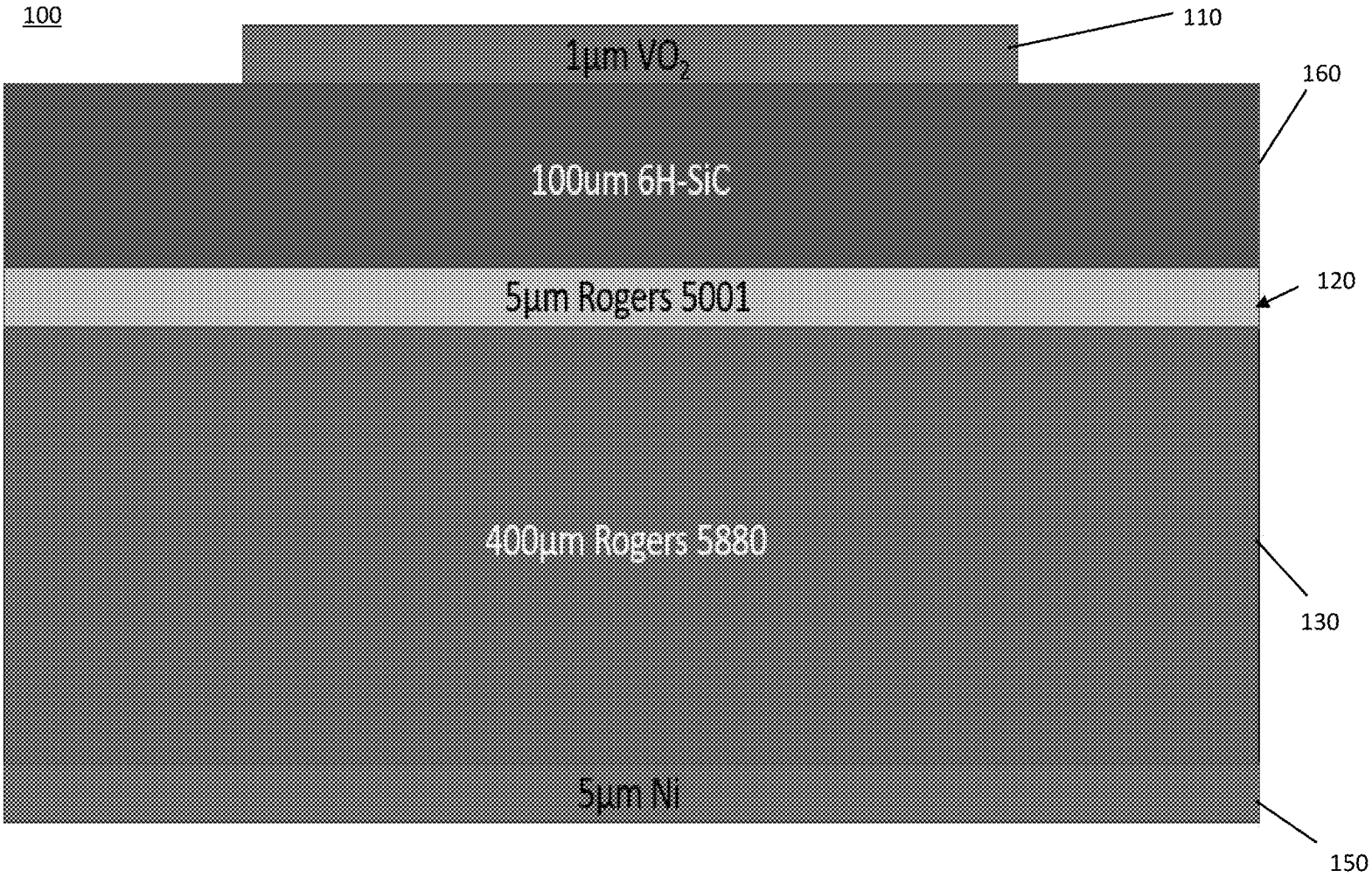

FIG. 1 shows an exploded schematic view of a reflectarray 100 of an embodiment of the subject invention. Referring to FIG. 1 a phase change material layer 110 (e.g., a $VO_2$ layer) can be disposed on a high-density micro-heater matrix 120 comprising micro-heaters (or pixels) 125 that can be switched on or off (e.g., via electronic control) and a micro-heater layer 127 (e.g., an insulating layer). The phase change material layer 110 can be referred to herein as the VO2 layer, but it is to be understood that it can be another phase change material with suitable characteristics. By controlling the micro-heaters 125 in this manner, the heat can be transferred to the $VO_2$ 110 layer and heat specific pixels of the $VO_2$ layer 110 to change the resistivity of the $VO_2$ in a desired pattern. That is, by activating certain micro-heaters 125 in a desired pattern, the $VO_2$ can be heated in the same desired pattern, thereby changing the properties in the desired pattern within the $VO_2$ layer 110 (or "activating" the $VO_2$ layer 110 in the desired pattern (e.g., by changing from insulator to conductor when heated). The $VO_2$ layer 110 can function as a reflector or main reflector, and this "activation" can change the reflecting properties of the $VO_2$ layer 110 in whatever pattern is desired, down to the resolution of the size of the micro-heaters 125. FIG. 2 shows a cross-sectional view of the reflectarray 100, with a close-up of the micro-heaters 125. FIG. 11(*b*) shows a cross-sectional view of the reflectarray, while FIG. 11(*a*) shows a cross-sectional view of a conventional design for comparison.

Referring still to FIG. 1, the micro-heater matrix 120 can be disposed on a substrate 130. Any suitable substrate can be used, such as a glass or laminate substrate. For example, the substrate 130 can comprise glass microfiber and/or polytetrafluoroethylene (PTFE) (e.g., a Duroid® substrate, such as Rogers 5880®). The substrate 130 can optionally include conductive lines 135 (e.g., one or more voltage lines and/or one or more ground lines) disposed thereon or therein. The reflectarray 100 can optionally further include an intermediate layer 160 disposed between the VO2 layer 110 and the micro-heater matrix 120. The intermediate layer 160 may function as a secondary substrate and can have a lower dielectric constant than the substrate 130 does. The reflectarray 100 can optionally further include a conductive ground plane 150 disposed below the substrate 130. An adhesive (not shown) can optionally be present between two or more of the adjacent elements (e.g., in one embodiment an adhesive (e.g., a thermal bonding film such as Rogers 3001® thermal bonding film) can be present between the substrate 130 and the intermediate layer 160).

The thickness of the $VO_2$ layer 110 can be any of the following values, about any of the following values, at least any of the following values, or greater than any of the following values (all values are in micrometers (μm)): 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.5, 3, 3.5, 4, 4.5, 5, 6, 7, 8, 9, 10, 15, 20, 25, 30, 35, 40, 45, 50, 60, 70, 80, 90, or 100. For example, the thickness of the $VO_2$ layer 110 can be 1 μm or about 1 μm.

The micro-heater layer 127 can be, for example, an insulating layer. The material of the micro-heater layer 127 can be any suitable material known in the art (e.g., silicon dioxide ($SiO_2$). The micro-heaters 125 can be any suitable heating element material known in the art (e.g., nickel chromium (NiCr)). The width and/or length of each micro-heater 125 can be any of the following values, about any of the following values, at least any of the following values, or greater than any of the following values (all values are in μm): 0.5, 1, 1.5, 2, 2.5, 3, 3.5, 4, 4.5, 5, 5.5, 6, 6.5, 7, 7.5, 8, 8.5, 9, 9.5, 10, 15, 20, 25, or 30. For example, the width and/or length of each micro-heater 125 can be 5 μm or about 5 μm.

6H—SiC could not be used directly as a substrate material due to its high dielectric constant of ~10.03, compared to conventional substrates like Rogers 5880 (2.2), Taconic TLX (2.4) or FR4 (4.4). Considering that it is necessary to have both high thermal conductivity and lower dielectric constant to transfer heat efficiently, as well as not attenuating the wave, we decided to go with a hybrid substrate approach that combined the 6H—SiC with Rogers 5880. The substrate 130 should have a dielectric constant of less than 10, and preferably less than 5. The substrate 130 can be, for example, Rogers 5880® (dielectric constant of 2.2), Taconic TLX® (dielectric constant of 2.4), or FR4 (dielectric constant of 4.4). This also means that hexagonal silicon carbide (6H—SiC) does not make for a good direct substrate 130 (though it may be used as an intermediate layer 160). The thickness of the substrate 130 can be any of the following values, about any of the following values, at least any of the following values, or greater than any of the following values (all values are in μm): 10, 20, 30, 40, 50, 60, 70, 80, 90, 100, 150, 200, 250, 300, 350, 360, 370, 380, 390, 395, 400, 405, 410, 420, 430, 440, 450, 500, 550, 600, 650, 700, 750, 800, 900, or 1000. For example, the thickness of the substrate 130 can be 400 μm or about 400 μm.

The conductive lines 135 can be any suitable material known in the art (e.g., nickel). The width of the conductive lines (if present) can be any of the following values, about any of the following values, at least any of the following values, or greater than any of the following values (all values are in μm): 0.5, 1, 1.5, 2, 2.5, 3, 3.5, 4, 4.5, 5, 5.5, 6, 6.5, 7, 7.5, 8, 8.5, 9, 9.5, 10, 15, 20, 25, or 30. For example, the width of the conductive lines (if present) can be 5 μm or about 5 μm.

The intermediate layer 160 can be, for example, a semiconductor layer, though embodiments are not limited thereto. In some embodiments, the intermediate layer can be a silicon-containing layer, such as a silicon carbide layer (e.g., 6H—SiC). The thickness of the intermediate layer (if present) can be any of the following values, about any of the following values, at least any of the following values, or greater than any of the following values (all values are in μm): 10, 20, 30, 40, 50, 60, 70, 80, 90, 95, 100, 105, 110, 120, 130, 140, 150, 200, 250, 300, 350, 400, 500, 600, 700, 800, 900, or 1000. For example, the thickness of the intermediate layer (if present) can be 100 μm or about 100 Also, the conductive ground plane 150 (if present) can be any conductive material (e.g., copper (Cu), aluminium (Al), silver (Ag), gold (Au), platinum (Pt), or palladium (Pd)).

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

Embodiments of the subject invention provide advantages over related art devices, which are fixed designs for reflectarrays. The limitations due to the fixed designs are narrow bandwidth on patch elements and differential spatial phase delay. With the ability to reconfigure the reflecting surface in a high-speed manner, embodiments of the subject invention can expand and/or tailor bandwidth as needed, as well as account for changes in the spatial phase delay.

Embodiments of the subject invention can be used for tailoring signals around objects that would undermine signal quality/strength. Smart RF environments could also use reflectarrays of embodiments to tailor high strength signals to specific areas around hallways, offices, neighborhoods, and city blocks all in real-time.

Embodiments of the subject invention provide ultra-reconfigurable devices based on the MIT property of $VO_2$. A $VO_2$ layer can be disposed on a high-density micro-heater matrix comprising pixels that can be switched on or off as desired (e.g., via electronic control). Controlling the pixels in this manner, heat can be transferred to the selected areas of the $VO_2$ layer, converting the selected areas to the highly conductive metallic phase of $VO_2$. This technique allows dynamic changing of the shape of the reflection antenna surface with high speed. The reflectarray is useful for 5G applications operating in a wide bandwidth (e.g., 32 to 86 GHz). Devices of embodiments of the subject invention can serve as a novel platform for ultra-reconfigurable reflectarrays and metasurfaces for various radio frequency (RF) applications in a wide spectral range.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

Figure 3B:
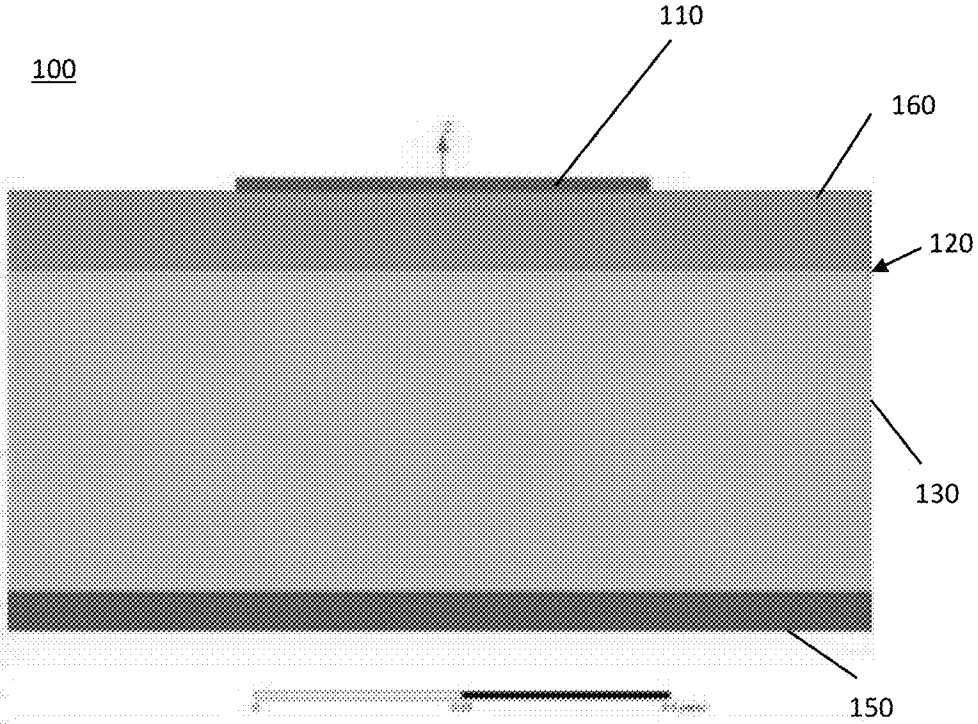
FIG. 3(*a*) shows a schematic view of a hybrid simulation with master and slave boundaries. The scale bar is 4 millimeters (mm) at the halfway point and 8 mm at the end of the black section.
Figure 3A:
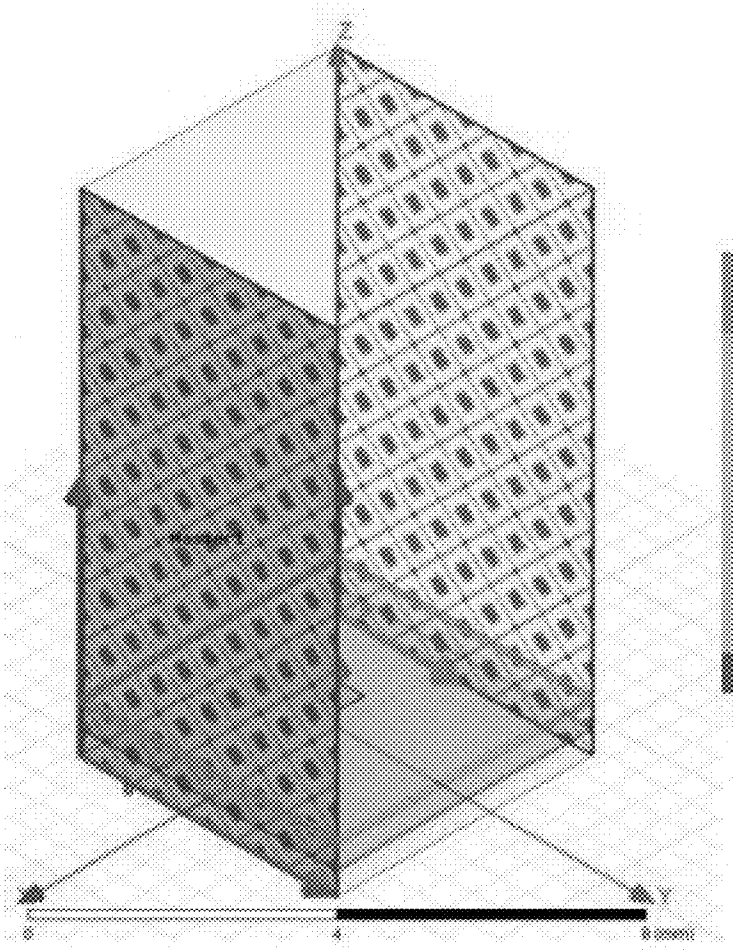

A unit cell of a reflectarray antenna was designed and simulated to examine characteristics of the unit cell. The unit cell is the fundamental unit that makes the whole of the reflectarray, and by changing the physical characteristics of the unit cell, the phase response can provide the phase design curve. The numerical analysis results were obtained by using Ansys HFSS. The master and slave boundaries were used as the periodic boundary conditions, and the fields ports were implemented using Floquet ports. In order to verify the simulations, results were replicated for an existing design using conventional RF materials and for 32 GHz operation (Nayeri et al., Reflectarray Antennas: Theory, Designs, and Applications, John Wiley & Sons Ltd, 2018; which is hereby incorporated by reference herein in its entirety). Because it is necessary to have high thermal conductivity and low dielectric constant to transfer heat efficiently, as well as not attenuating the wave, a hybrid substrate approach was used with a substrate of Rogers 5880® and an intermediate layer of 6H—SiC with Rogers 5880. FIGS. 3(*a*) and 3(*b*) show the structure of this hybrid approach (including the intermediate layer 160) in HFSS. Three versions of the simulation were considered: one assuming an ideal bond (direct attachment of 6H—SiC on the Rogers 5880®); one assuming an imperfect bond including a 5 μm air gap; and one using Rogers 3001® thermal bonding film. The thickness of the substrate was 400 μm, and the thickness of the 6H—SiC intermediate layer was 100 μm. The inter-element spacing was selected as 0.5λ, where λ is the free-space wavelength at 32 gigahertz (GHz). The heating element comprised a square patch that varied in length and width from 0.5 millimeters (mm) to 4.5 mm at an interval of 0.1 mm. The resistivity of the $VO_2$ layer was assumed to be $\rho=10^{-5}$ Ohm-meters (Ω-m), which is a conservative value compared to experimentally achieved ones, and the thickness of the $VO_2$ layer was 1 μm.

Figure 4:
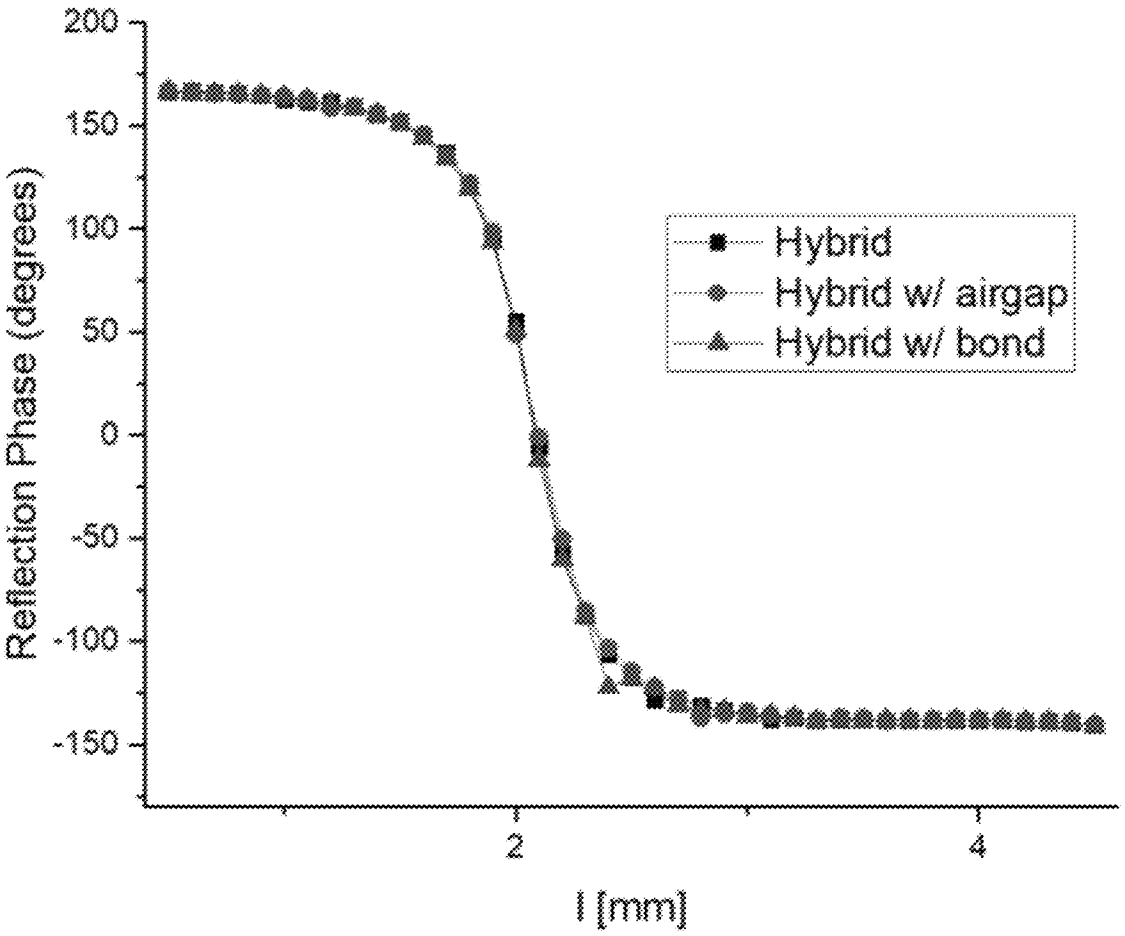
FIG. 4 shows a plot of reflection phase (in degrees) versus square patch size (in mm), showing simulated reflection phase curves of three different hybrid structures at a frequency of 32 gigahertz (GHz). The curve with the square data points is for the hybrid design, with the intermediate layer directly bonded to the substrate; the curve with the circular data points is for the hybrid design with an airgap (an imperfect bond between the intermediate layer and the substrate); and the curve with the triangular data points is for the hybrid design with a thermal bonding film between the intermediate layer and the substrate.

FIG. 4 shows a plot of reflection phase (in degrees) versus square patch size (in mm), showing simulated reflection phase curves of the three different hybrid structures at a frequency of 32 GHz. The characteristics show well-defined S-curves typical for reflection arrays covering a large phase range of about 310°. There is practically no difference between the three investigated hybrid cases, which indicates flexibility in physical implementation.

Figure 5:
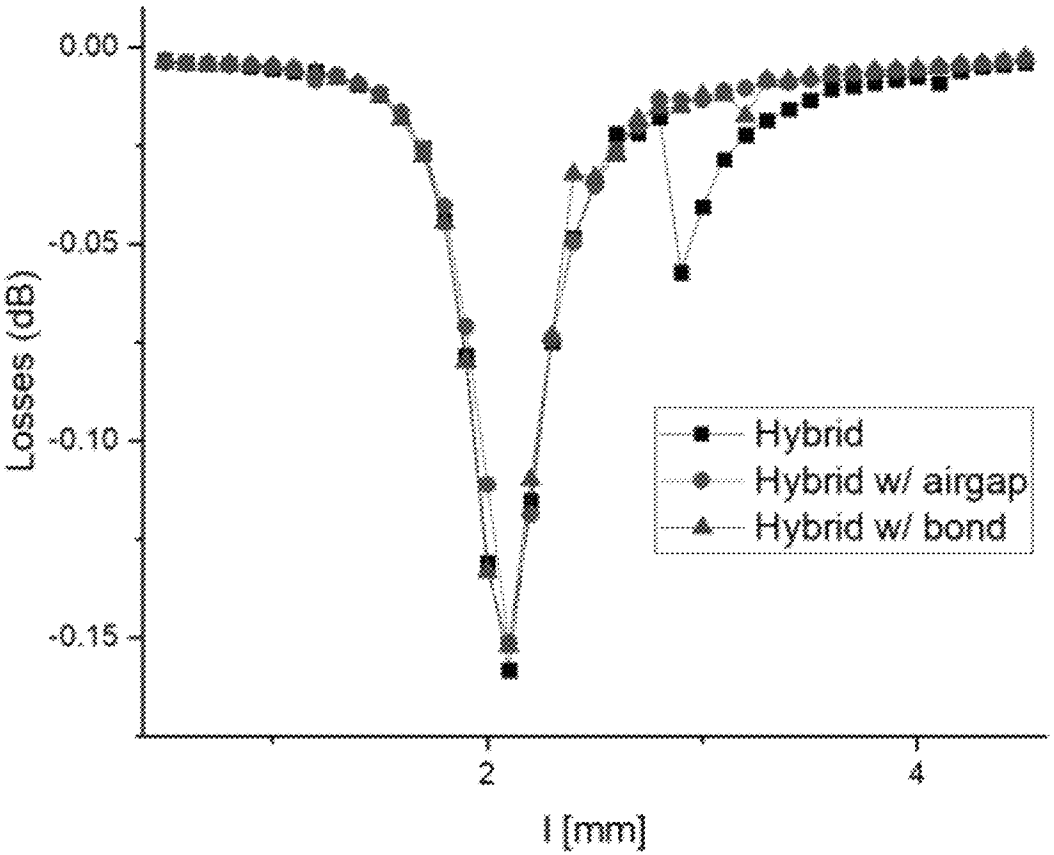
FIG. 5 shows a plot of losses (in decibels (dB)) versus square patch size (in mm), showing simulated reflection loss curves of three different hybrid structures at a frequency of 32 GHz. The curve with the square data points is for the hybrid design, with the intermediate layer directly bonded to the substrate; the curve with the circular data points is for the hybrid design with an airgap (an imperfect bond between the intermediate layer and the substrate); and the curve with the triangular data points is for the hybrid design with a thermal bonding film between the intermediate layer and the substrate.

FIG. 5 shows a plot of losses (in decibels (dB)) versus square patch size (in mm), showing simulated reflection loss curves of the three different hybrid structures at a frequency of 32 GHz. The results show practically the same loss characteristics with a reflection loss no greater than −0.17 dB for all three cases. It's important to note that for the sake of efficiency, the micro-heater matrix was left out from the HFSS simulations, as it is only 66 μm and makes up less than 0.01λ, which would be expected to have minimal impact (if any) on the s-curve.

Example 2

In order to verify thermal propagation through the 6H—SiC intermediate layer, as well as verify patch size, thermal simulations were performed using a commercial multiphysics finite element model (FEM) (COMSOL™) with the joule heating module with an electromagnetic heat source and physics of heat transfer in solids.

Figure 6:
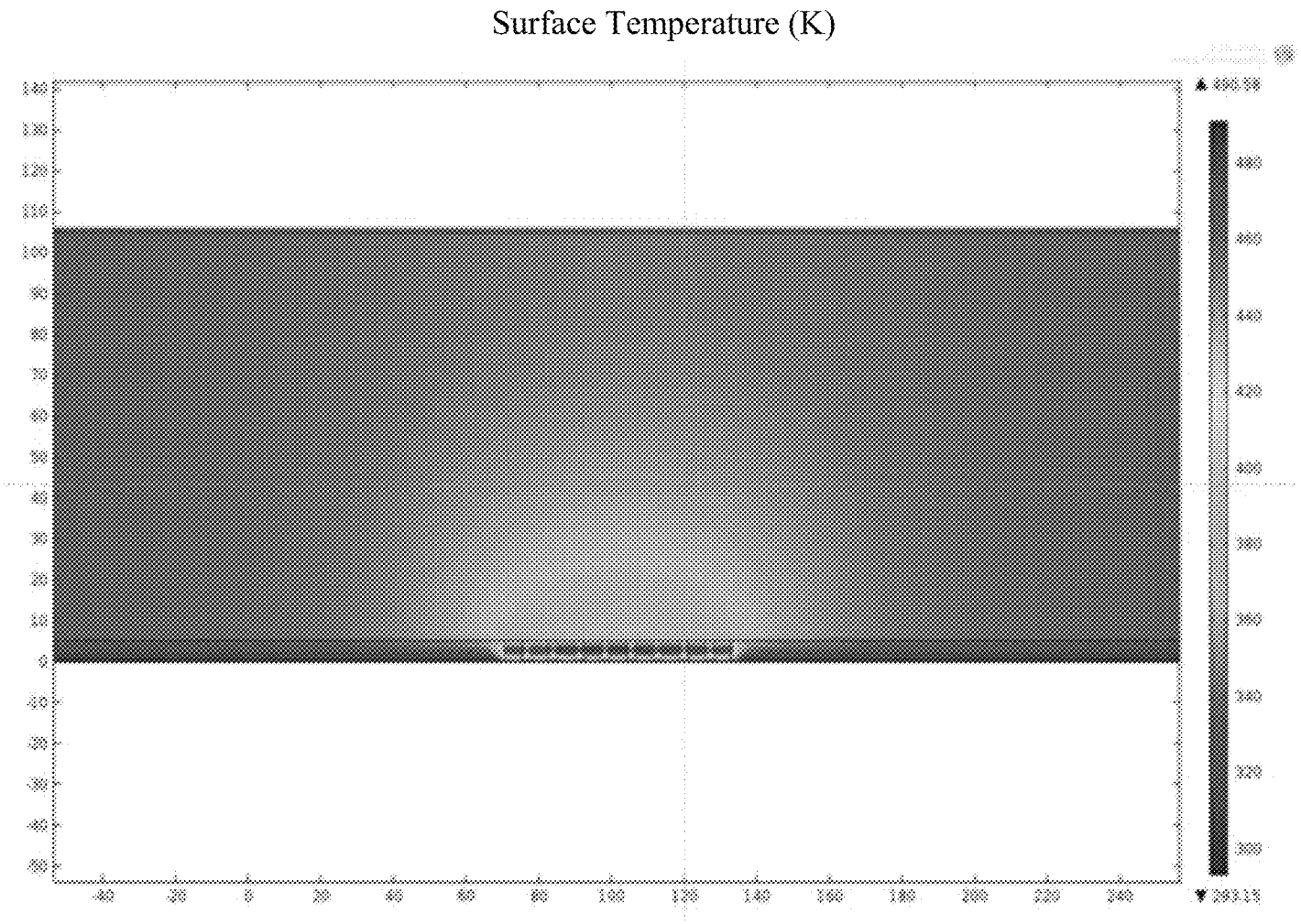
FIG. 6 shows surface temperature (in Kelvin (K)) in a cross-sectional view of an intermediate layer (of hexagonal silicon carbide (6H—SiC)), illustrating how thermal evolution propagates to the surface.

FIG. 6 shows the design in COMSOL™ after a steady state solution, and also shows surface temperature (in Kelvin (K)) in a cross-sectional view of the intermediate layer (of 6H—SiC), illustrating how thermal evolution propagates to the surface. This analysis allowed for fine tuning of the distance between the micro-heaters such that the pixels' transition edges just overlap enough to create a seamless and thermally homogeneous connection between pixels. Thermal analysis also allowed for fine tuning of the micro-heater serpentine parameters so that it could be made as efficient as possible. The meandered heating element is 66 μm×65 μm and has a 15.5 Volt (V) potential applied across it. The rear of the device is kept at room temperature, a condition which could be easily satisfied physically by using a cooling element.

Figure 7:
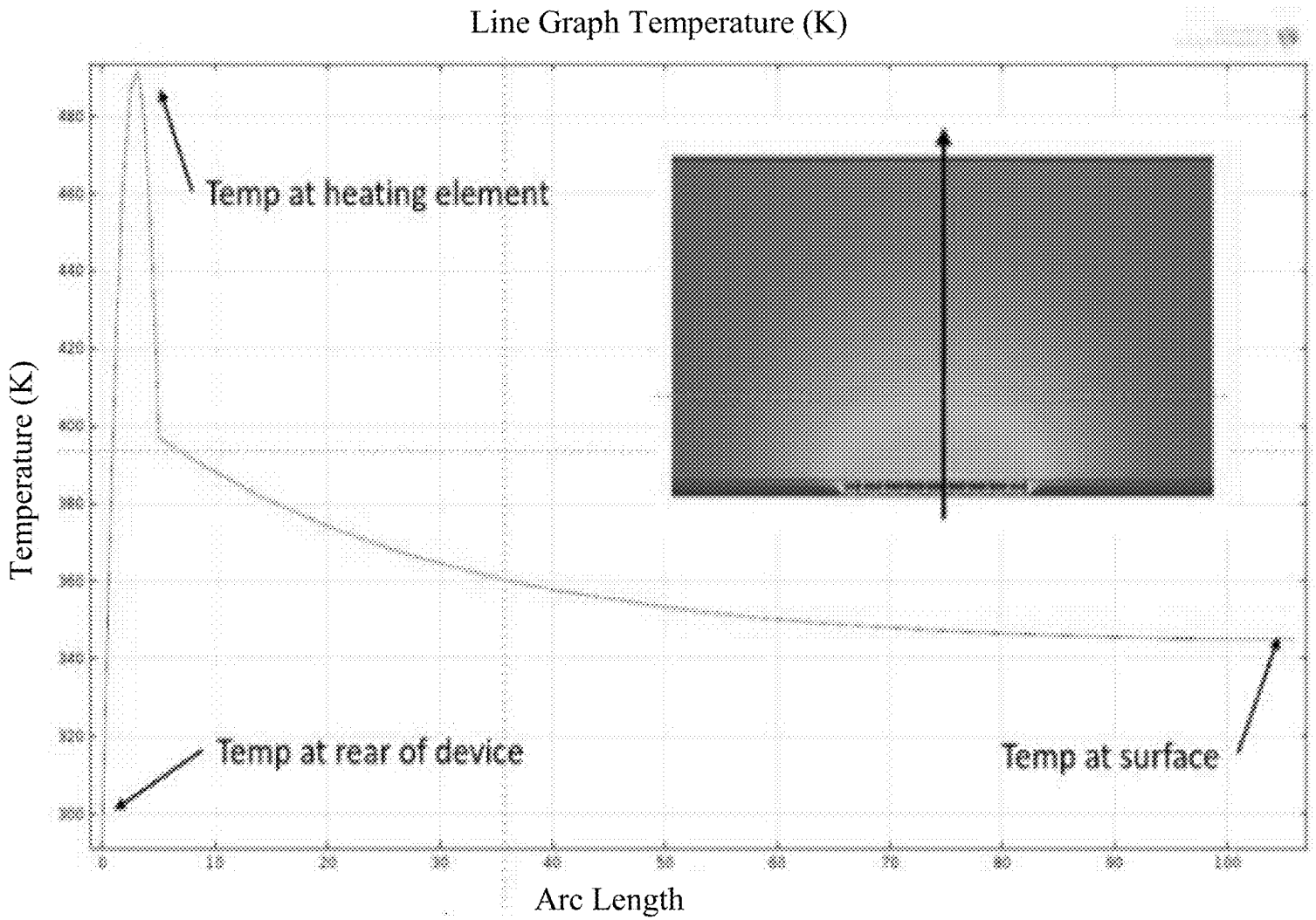
FIG. 7 shows line graph temperature (in K) in a cross-sectional view of a reflectarray, illustrating heat propagation from a rear of a heating element to the surface of a vanadium dioxide ($VO_2$) layer.
Figure 8:
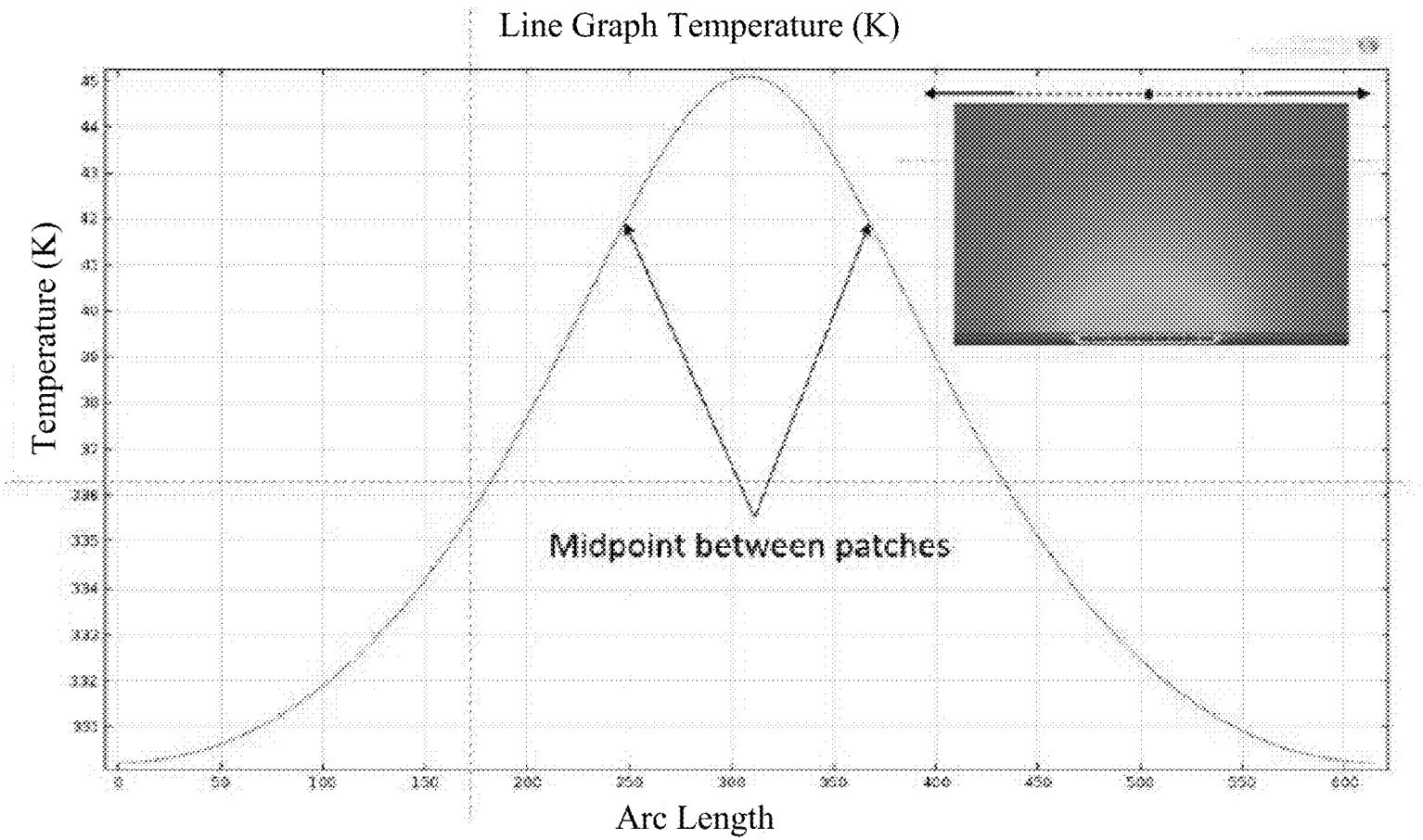
FIG. 8 shows line graph temperature (in K) in a cross-sectional view of a reflectarray, illustrating a thermal spot created at the surface of a $VO_2$ layer, with a 100 μm patch size.

FIGS. 7 and 8 show plots of heat propagating from the bottom up to the surface, and from the center of the $VO_2$ surface towards the outer edge, respectively. These are for a reflectarray as described in Example 1. Referring to FIGS. 7 and 8, the data prove that it is possible to heat up the top $VO_2$ layer to 345 K and thereby convert from insulating phase to highly conductive metallic phase by heating the matrix elements to 490 K. The lateral temperature distribution data verifies that a 100 μm×100 μm patch size can be attained by using the structure of embodiments of the subject invention and the thermal conditions described in this example.

Example 3

A simulation was performed similar to Example 1, using a reflectarray as described in Example 1, but with heating of a pixel size of 615 μm×615 μm to generate metallic $VO_2$ patches or arbitrary shapes with the same spatial resolution. A large phase range of about 360° and low loss between −0.13 dB and −0.48 dB were obtained.

Example 4

Figures 9A, 9B:
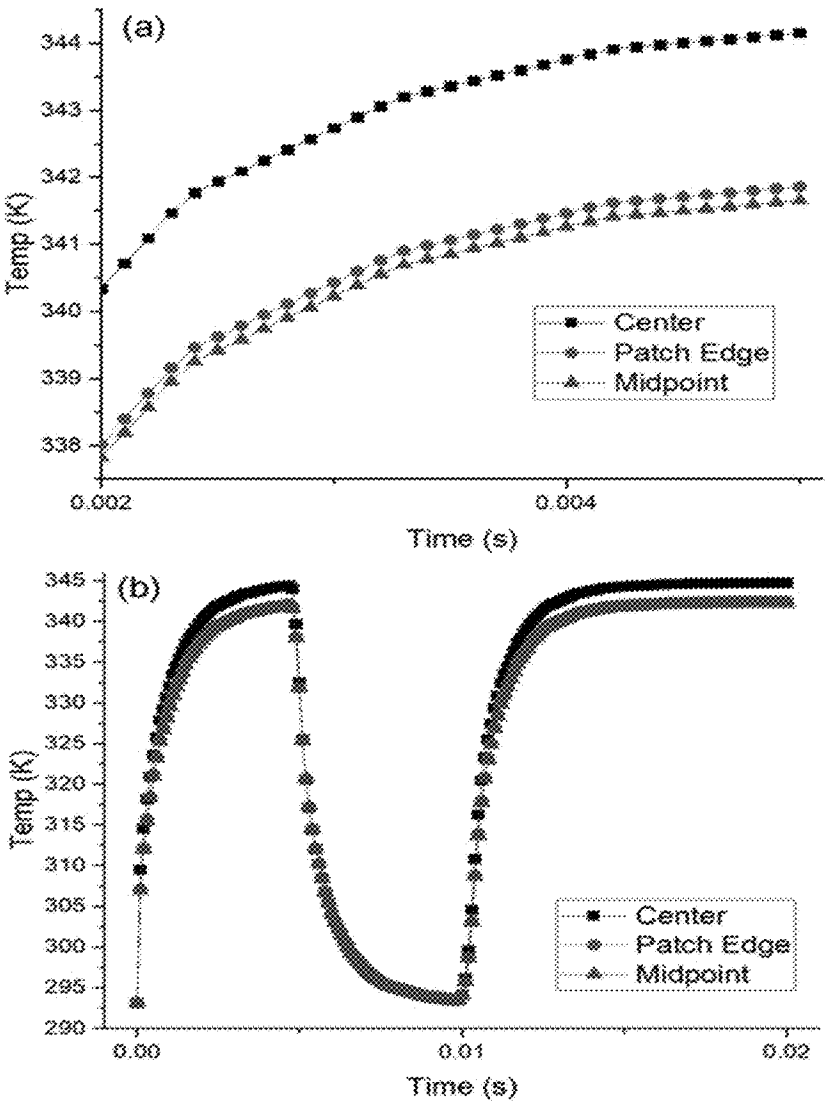
FIG. 9(*a*) shows a plot of temperature (in K) versus time (in seconds (s)), illustrating high resolution time-dependent analysis at the center of the patch, the edge of the patch, and at the midpoint between patch edges. The (black) line with the square data points is for the center; the (red) line with the circular data points is for the edge; and the (blue) line with the triangular data points is for the midpoint.

A time-dependent analysis was also conducted on a reflectarray as described in Example 1. The time-dependent solution is given by:

$$\rho C_p \frac{\partial T}{\partial t} + \rho C_p u \cdot \nabla T = \nabla \cdot (k \nabla T) + Q, \quad (1)$$

where T, t, ρ, Cp, u, k represent the temperature, time, mass density, heat capacity, velocity vector, and thermal conductivity of the medium, respectively. FIG. 9(*a*) shows the temperature at three different positions: the center of the patch; the edge of the patch; and at the midpoint between patch edges. The time-dependent analysis shows that the device can reach the transition temperature threshold within 5 milliseconds (ms).

The same points on the patch were also analyzed during an on-off-on cycle to understand the complete cycle turn-around time for the unit cell, with results shown in FIG. 9(*b*). The time for the cell to completely reach room temperature, using passive cooling via radiative and atmospheric losses, then back to its transition temperature was about 15 ms. This transient time could be further improved if thermal management methods are employed. These results show that fast transition times can be achieved, and these are important for real-time reconfiguring of the patch size, shape, and distribution.

Example 5

Figure 10:
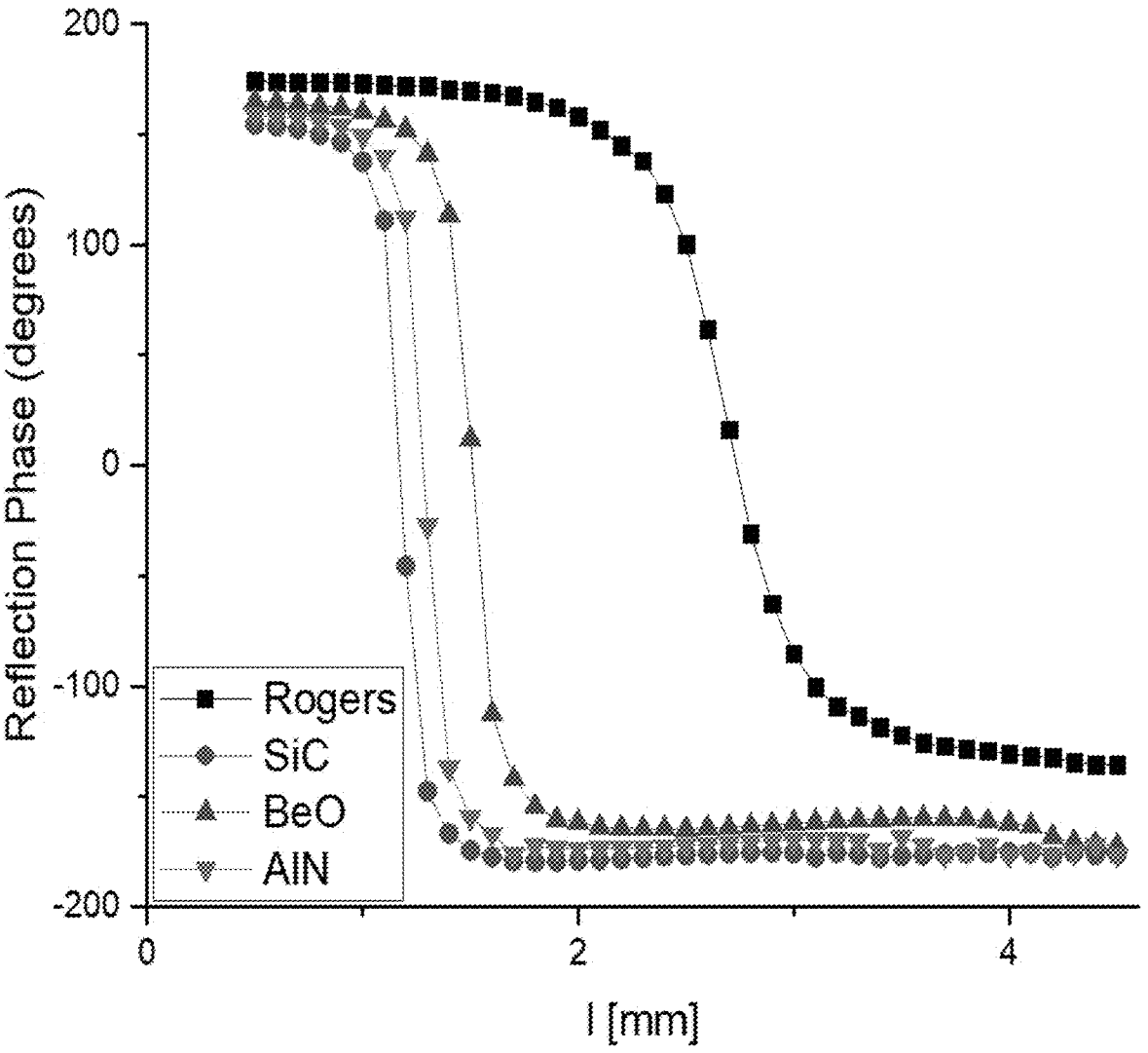
FIG. 10 shows a plot of reflection phase (in degrees) versus square patch size (in mm), illustrating reflection phase curves for a base design with varying materials. The (black) line with the square data points is for a Rogers material; the (red) line with the circular data points is for SiC; the (blue) line with the right-side-up triangular data points is for beryllium oxide (BeO); and the (pink) line with the upside-down triangular data points is for aluminium nitride (AlN).

Ansys HFSS was used for numerical analysis of the radio frequency (RF) reflection characteristics of a unit cell. The master and slave boundaries were used as the periodic boundary conditions, and the fields ports were implemented using Floquet ports. In order to verify the simulations, results of an existing design using conventional RF materials and for 32 GHz operation were replicated. FIG. 10 shows the replicated reflection phase curve, as well as the curve when Rogers is replaced with various materials. This design was used to verify the simulation integrity.

Example 6

FIGS. 11(*b*) and 11(*a*) show the structure of the hybrid approach in contrast to the conventional design, respectively. Three versions of the simulation were considered: one assuming an ideal bond (direct attachment of SiC on the Rogers 5880®); an imperfect bond including a 5 μm air gap; and one using 5 μm of Rogers 3001® thermal bonding film. For the hybrid analysis, 400 μm-thick Rogers 5880® and 100 μm-thick 6H—SiC were used. As alternatives to 6H—SiC, 100 μm-thick BeO and AlN were also analyzed with the hybrid approach. The inter-element spacing was selected as 0.5λ, where λ is the free-space wavelength at 32 GHz.

The element included square patch that varies in length and width from 0.5 mm to 4.5 mm at an interval of 0.1 mm. $\rho=10^{-5}$ Ohm-meters (Ω-m), which is a conservative value compared to experimentally achieved ones, and the thickness of the $VO_2$ layer was 1 μm.

Figures 12A, 12B, 12C, 12D:
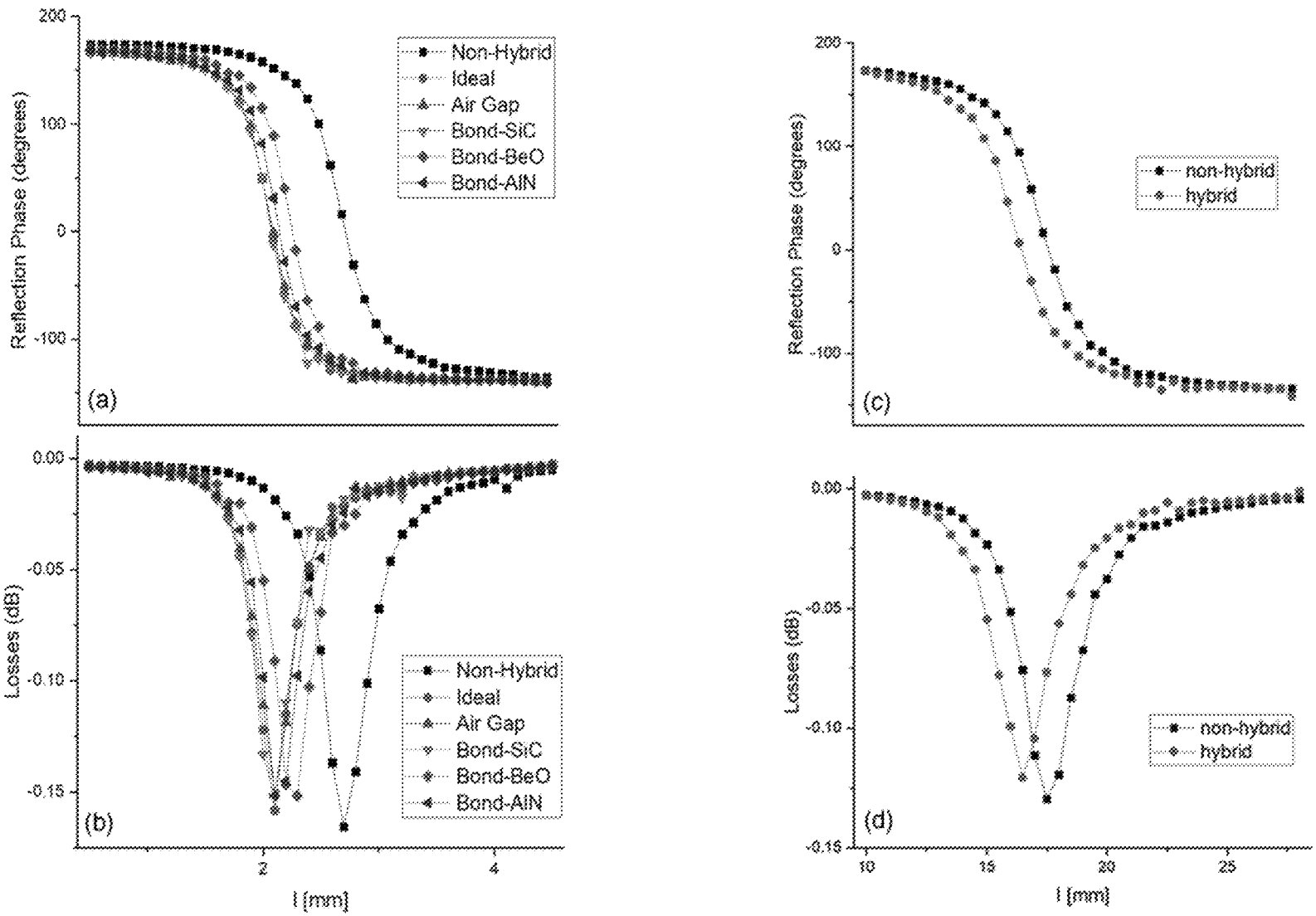
FIG. 12(*a*) shows a plot of reflection phase (in degrees) versus square patch size (in mm) illustrating reflection phase curves of three different simulated hybrid structures at a frequency of 32 GHz. The (black) line with the square data points is for a non-hybrid; the (red) line with the circular data points is for the ideal case; the (blue) line with the right-side-up triangular data points is for an air gap; the (pink) line with the upside-down triangular data points is for bond-SiC; the (green) line with the diamond data points is for bond-BeO; and the (dark blue) line with the left-pointing triangular data points is for bond-AlN.

FIG. 12(*a*) shows the reflection angle as a function of the square patch size of the investigated structures with the ideal bond, imperfect bond, and Rogers 3001® cases. The results showed a well-defined S-curve typical for reflection arrays covering a large phase range of about 310°. There was practically no difference between the investigated three hybrid cases, which indicates flexible physical implementation.

FIG. 12(*b*) shows the losses in dB for the same designs. The results showed practically the same loss characteristics with a reflection loss no greater than −0.17 dB for all three cases. It is important to note that for the sake of efficiency, the heating matrix was left out from the HFSS simulations, as each is only 66 μm and makes up less than 0.01λ, which would be expected to have little to no impact on the S-curve.

Mid-band 5G range, which is current communications technology, was also probed. This range is considered to be between 1 GHz to 6 GHz. A reflectarray unit cell was designed using both standard design structure and the hybrid structure to achieve the ultra-reconfigurability using $VO_2$. Due to the change in frequency, the dimensions of the reflectarray patch would have to change. The inter-element spacing was selected as 0.5λ, where λ is the free-space wavelength at 5 GHz. The element included a square patch that varies in length and width from 10 mm to 28 mm at an interval of 0.5 mm. For the hybrid analysis, 3 mm-thick Rogers 5880® and 100 μm-thick 6H—SiC were used. FIG. 12(*c*) shows the reflection phase curves, and FIG. 12(*d*) shows the reflection loss curves.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A reflectarray, comprising:

a substrate monolithically formed of a same material, the substrate comprising an upper surface and a lower surface opposite from the upper surface;

a micro-heater matrix disposed on and facing the upper surface of the substrate and comprising a micro-heater layer and a plurality of micro-heaters, the plurality of micro-heaters being configured to be controlled to turn on or off individually;

a vanadium dioxide ($VO_2$) layer disposed on the micro-heater matrix, the $VO_2$ layer comprising a lower surface facing the micro-heater matrix and an upper surface opposite from the lower surface, the upper surface of the $VO_2$ layer being exposed to an outside; and a ground plane disposed below and in direct physical contact with the lower surface of the substrate, the ground plane comprising an upper surface facing the micro-heater matrix and a lower surface opposite from the upper surface, the lower surface of the around plane being exposed to the outside, the $VO_2$ layer configured such that specific areas of the $VO_2$ layer, corresponding to micro-heaters of the plurality of micro-heaters that are turned on and heated to a predetermined temperature, heat up and cause the specific areas of the $VO_2$ layer to change from insulating to conducting.

2. The reflectarray according to claim 1, further comprising an intermediate layer disposed between the $VO_2$ layer and the micro-heater matrix.

3. The reflectarray according to claim 2, the intermediate layer being a silicon carbide (SiC) layer.

4. The reflectarray according to claim 3, the intermediate layer being a hexagonal SiC (6H—SiC) layer.

5. The reflectarray according to claim 2, a dielectric constant of the intermediate layer being higher than that of the substrate.

6. The reflectarray according to claim 1, the micro-heater layer being an insulating layer.

7. The reflectarray according to claim 1, the plurality of micro-heaters being configured to be controlled to turn on or off individually via electronic control.

8. The reflectarray according to claim 1, further comprising a ground plane disposed below the substrate.

9. The reflectarray according to claim 1, further comprising a plurality of conductive lines disposed on the substrate, the plurality of conductive lines comprising a ground line and a plurality of voltage lines.

10. The reflectarray according to claim 1, the plurality of micro-heaters being contained within a patch area on the micro-heater layer, and the patch area having a width of no more than 100 μm and a length of no more than 100 μm.

11. The reflectarray according to claim 1, the predetermined temperature being at least 480 Kelvin (K).

12. A method of steering a beam using a reflectarray, the method comprising:

providing the reflectarray, the reflectarray comprising:

a substrate monolithically formed of a same material, the substrate comprising an upper surface and a lower surface opposite from the upper surface;

a micro-heater matrix disposed on and facing the upper surface of the substrate and comprising a micro-heater layer and a plurality of micro-heaters, the plurality of micro-heaters being configured to be controlled to turn on or off individually; and a vanadium dioxide ($VO_2$) layer disposed on the micro-heater matrix, the $VO_2$ layer comprising a lower surface facing the micro-heater matrix and an upper surface opposite from the lower surface, the upper surface of the $VO_2$ layer being exposed to an outside, and a ground plane disposed below and in direct physical contact with the lower surface of the substrate, the ground plane comprising an upper surface facing the micro-heater matrix and a lower surface opposite from the upper surface, the lower surface of the around plane being exposed to the outside, the $VO_2$ layer configured such that specific areas of the $VO_2$ layer, corresponding to micro-heaters of the plurality of micro-heaters that are turned on and heated to a predetermined temperature, heat up and cause the specific areas of the $VO_2$ layer to change from insulating to conducting;

controlling the plurality of micro-heaters to turn on a subset of micro-heaters of the plurality of micro-heaters and allow the subset of micro-heaters to heat to the predetermined temperature, such that the specific areas of the $VO_2$ layer change from insulating to conducting in a desired pattern for steering the beam; and providing the beam from a feed antenna towards the reflectarray such that the $VO_2$ layer with the specific areas forming the desired pattern reflects and steers the beam.

13. The method according to claim 12, the reflectarray further comprising an intermediate layer disposed between the $VO_2$ layer and the micro-heater matrix, and a dielectric constant of the intermediate layer being higher than that of the substrate.

14. The method according to claim 13, the intermediate layer being a hexagonal silicon carbide (6H—SiC) layer.

15. The method according to claim 12, the micro-heater layer being an insulating layer.

16. The method according to claim 12, the plurality of micro-heaters being configured to be controlled to turn on or off individually via electronic control.

17. The method according to claim 12, the reflectarray further comprising:

a ground plane disposed below the substrate; and a plurality of conductive lines disposed on the substrate, the plurality of conductive lines comprising a ground line and a plurality of voltage lines.

18. The method according to claim 12, the plurality of micro-heaters being contained within a patch area on the micro-heater layer, and the patch area having a width of no more than 100 μm and a length of no more than 100 μm.

19. The method according to claim 12, the predetermined temperature being at least 480 Kelvin (K).

20. A reflectarray, comprising:

a substrate monolithically formed of a same material, the substrate comprising an upper surface and a lower surface opposite from the upper surface;

a micro-heater matrix disposed on and facing the upper surface of the substrate and comprising a micro-heater layer and a plurality of micro-heaters, the plurality of micro-heaters being configured to be controlled to turn on or off individually; and a vanadium dioxide ($VO_2$) layer disposed on the micro-heater matrix, the $VO_2$ layer comprising a lower surface facing the micro-heater matrix and an upper surface opposite from the lower surface, the upper surface of the $VO_2$ layer being exposed to an outside;

an intermediate layer disposed between the $VO_2$ layer and the micro-heater matrix;

a ground plane disposed below and in direct physical contact with the lower surface of the substrate, the ground plane comprising an upper surface facing the micro-heater matrix and a lower surface opposite from the upper surface, the lower surface of the ground plane being exposed to the outside; and a plurality of conductive lines disposed on the substrate, the plurality of conductive lines comprising a ground line and a plurality of voltage lines, the $VO_2$ layer configured such that specific areas of the $VO_2$ layer, corresponding to micro-heaters of the plurality of micro-heaters that are turned on and heated to a predetermined temperature, heat up and cause the specific areas of the $VO_2$ layer to change from insulating to conducting, a dielectric constant of the intermediate layer being higher than that of the substrate, the intermediate layer being a hexagonal silicon carbide (SiC) layer, the micro-heater layer being an insulating layer, the plurality of micro-heaters being configured to be controlled to turn on or off individually via electronic control, the plurality of micro-heaters being contained within a patch area on the micro-heater layer, and the patch area having a width of no more than 100 μm and a length of no more than 100 μm, and the predetermined temperature being at least 480 Kelvin (K).

* * * * *